US007907737B2

(12) United States Patent
Kanishima et al.

(10) Patent No.: US 7,907,737 B2
(45) Date of Patent: Mar. 15, 2011

(54) ACOUSTIC APPARATUS

(75) Inventors: Yasuhiro Kanishima, Ome (JP); Toshifumi Yamamoto, Sagamihara (JP); Norikatsu Chiba, Kawasaki (JP); Shigeyasu Iwata, Hamura (JP); Kazuyuki Saito, Hamura (JP); Takashi Fukuda, Ome (JP); Yutaka Oki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/636,078

(22) Filed: Dec. 11, 2009

(65) Prior Publication Data

US 2010/0150362 A1 Jun. 17, 2010

(30) Foreign Application Priority Data

Dec. 12, 2008 (JP) ..... 2008-317570

(51) Int. Cl.
*H04R 25/00* (2006.01)

(52) U.S. Cl. ..... 381/60; 381/312

(58) Field of Classification Search ..... 381/23.1, 381/60, 312; 379/52
See application file for complete search history.

(56) References Cited

U.S. PATENT DOCUMENTS

| | | | | |
|---|---|---|---|---|
| 6,674,867 | B2 * | 1/2004 | Basseas | 381/60 |
| 7,340,062 | B2 * | 3/2008 | Revit et al. | 381/60 |
| 7,688,983 | B2 * | 3/2010 | Voix et al. | 381/60 |

FOREIGN PATENT DOCUMENTS

| | | |
|---|---|---|
| JP | 09-187093 | 7/1997 |
| JP | 2000-092589 | 3/2000 |
| JP | 2005-338453 | 12/2005 |
| JP | 2007-235724 | 9/2007 |

OTHER PUBLICATIONS

Japanese Office Action dated Mar. 9, 2010, Japanese Patent Application No. 2008-317570.

* cited by examiner

*Primary Examiner* — Suhan Ni
(74) *Attorney, Agent, or Firm* — Patterson & Sheridan, LLP

(57) ABSTRACT

According to one embodiment, an acoustic apparatus comprises a measuring signal generator, a transducer configured to convert a measuring signal to a measuring sound and to convert a characteristic vibration of the transducer due to the measuring sound, to a characteristic vibration signal, an analysis module configured to analyze the characteristic vibration signal in order to output a physical quality of a characteristic vibration of the transducer, a controller configured to set a first state in which the transducer converts an electric signal to an acoustic signal or a second state in which the transducer converts an acoustic signal to an electric signal. The measuring signal generator is connected to the transducer in the first state and the analysis module is connected to the transducer in the second state.

11 Claims, 11 Drawing Sheets

ACOUSTIC APPARATUS

CROSS-REFERENCE TO RELATED APPLICATIONS

This application is based upon and claims the benefit of priority from Japanese Patent Application No. 2008-317570, filed Dec. 12, 2008, the entire contents of which are incorporated herein by reference.

BACKGROUND

1. Field

One embodiment of the invention relates to an acoustic apparatus for measuring and correcting the resonance characteristics of the outer-ear canals of a listener, to which a sound source signal is supplied from an earphone or a headphone.

2. Description of the Related Art

While listening to music through an earphone or a headphone (hereinafter, "earphone"), a listener may perceive an unnatural sound when the outer-ear canals are plugged with the earphone and resonance occurs due to interference with the sound waves reflected from the eardrums, emphasizing the sound of the resonance frequency. It is therefore desirable to measure the resonance characteristics of the outer-ear canals and to correct the resonance characteristics before the listener starts listening to music.

The shapes and acoustic transmission characteristic of outer-ear canals, and the physical properties and acoustic transmission characteristic of eardrums differ from person to person. Further, the resonance in either outer-ear canal changes in accordance with the type of the earphone and the state in which the earphone is held in the outer-ear canal. Hence, the resonance characteristics of the outer-ear canals must be measured and corrected for each earphone and each listener in order to achieve accurate measurement and correction of the resonance characteristics of the outer-ear canals.

Jpn. Pat. Appln. KOKAI Publication No. 2004-320098 describes a damping control circuit for use in earphones (see paragraph 0013). This circuit suppresses the vibration of the diaphragms of the earphone, which is pertinent to the resonance characteristics of the outer-ear canals. The damping factor becomes larger in the frequency domain of 3 to 4 kHz, where the acoustic gain of the outer-ear canals is maximal. Hence, the harmful vibration of the diaphragms of the earphone, which pertains to the resonance characteristics of the outer-ear canals, can be effectively controlled.

In the damping apparatus for use in earphones, which is disclosed in the above-identified publication, the damping factor becomes larger in the frequency domain of 3 to 4 kHz, where the acoustic gain of the outer-ear canals is maximal. The harmful vibration of the diaphragms of the earphone, which pertains to the resonance characteristics of the outer-ear canals, can therefore be effectively controlled. However, the resonance characteristics of the listener's outer-ear canals cannot be measured or corrected to accord with the vibration characteristic of the earphone.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an acoustic apparatus comprises a measuring signal generator configured to generate a pulse; a transducer configured to convert the pulse to a sound to be output to a free sound field and to convert a characteristic vibration of the transducer to a characteristic vibration signal; a signal analysis module configured to analyze the characteristic vibration signal in order to output a physical quality representing the characteristic vibration of the transducer; a controller configured to set one of a first state in which the transducer converts an electric signal to a sound and a second state in which the transducer converts a sound to an electric signal; and a switch configured to connect the measuring signal generator to the transducer in the first state and to connect the signal analysis module to the transducer in the second state.

Acoustic apparatuses according to embodiments of this invention will be described with reference to the accompanying drawings.

First Embodiment

Figure 1:
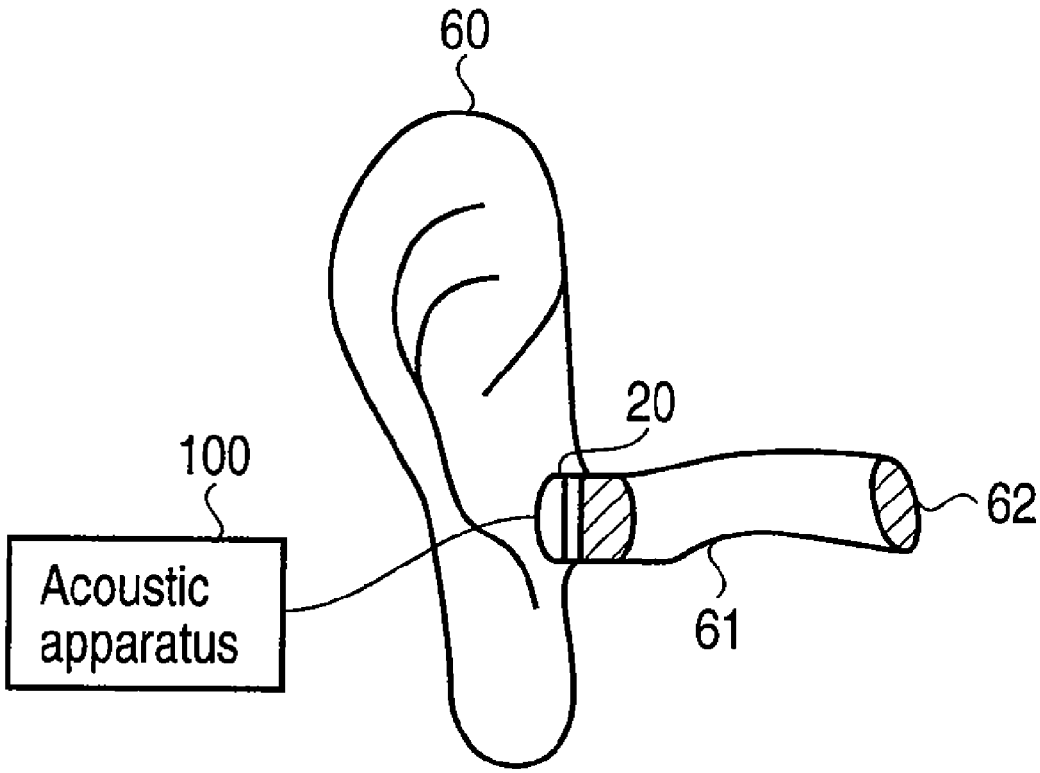
FIG. 1 is an exemplary diagram showing the concept of measuring and correcting the acoustic transmission characteristics in embodiments of the present invention.

FIG. 1 is a diagram showing the concept of measuring and correcting the acoustic transmission characteristics of the outer-ear canals, in an embodiment of the present invention.

A listener 60, who is a subject of measuring, has eardrums 62, each in one end of either outer-ear canal 61. An electric/acoustic transducer 20 plugs the other end of the listener's outer-ear canal 61. Devices that convert an electric signal to an acoustic signal (or sound), or vice versa, such as earphones and headphones, shall be called "electric/acoustic transducer 20."

An acoustic signal output from the electric/acoustic transducer 20 passes through the outer-ear canal 61 of the listener 60, reaching the eardrum 62. The acoustic signal interferes with the sound reflected from the eardrum 62 of the listener 60, causing resonance in the outer-ear canal 61. The electric/acoustic transducer 20 is electrically connected to an acoustic apparatus 100. The acoustic apparatus 100 acquires the physical quantity inherent to the resonance characteristic of the outer-ear canal 61 of the listener 60. In accordance with the physical quantity acquired by the acoustic apparatus 100, the sound source signal to be supplied to the listener 60 can be corrected to a predetermined characteristic (to reduce the gain at the resonance frequency). Since the left and right outer-ear canals differ in characteristic, two electric/acoustic transducers 20 for the left and right outer-ear canals are connected to the acoustic apparatus 100. Thus, the physical quantity inherent to the resonance characteristic of the left outer-ear canal and the physical quantity inherent to the resonance characteristic of the right outer-ear canal are acquired.

The acoustic apparatus 100 may be connected to, or incorporated in, an external apparatus that has an audio playback function, such as a personal computer (PC), a music player or an optical-disk player.

Figure 2:
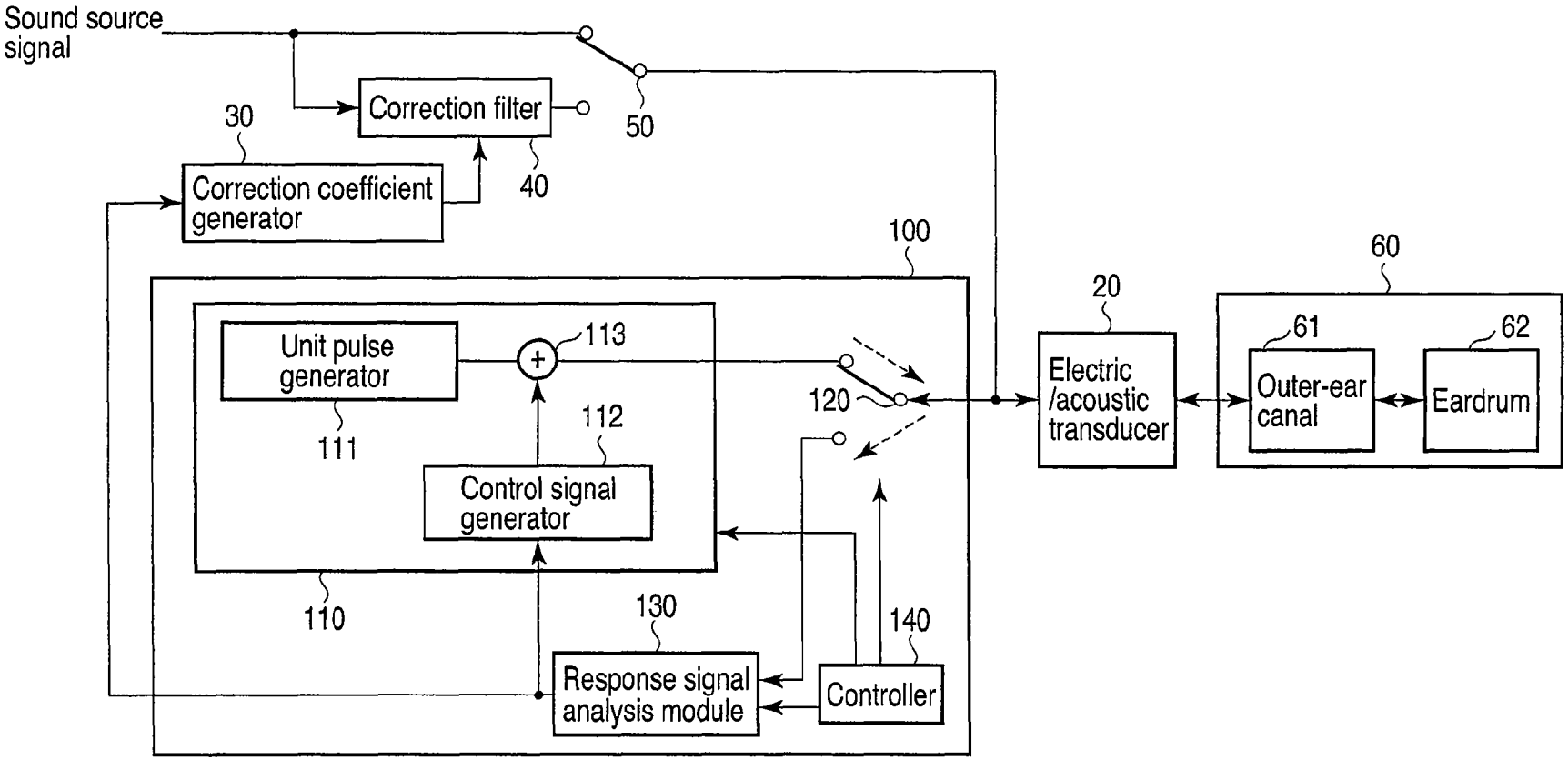
FIG. 2 is an exemplary block diagram showing an exemplary configuration of an acoustic apparatus 100 according to a first embodiment of the present invention.

FIG. 2 is a block diagram showing an exemplary configuration of the acoustic apparatus 100 according to the first embodiment. The acoustic apparatus 100 comprises a measuring signal generator 110, a switch 120, a response signal analysis module 130, and a controller 140. The acoustic apparatus 100 is electrically connected to, or formed integral with, either electric/acoustic transducer 20.

A correction coefficient generator 30 and a correction filter 40 are arranged outside the acoustic apparatus 100. The correction coefficient generator 30 generates a correction coefficient on the basis of the physical quantity inherent to the resonance characteristic of the outer-ear canal 61 of the listener 60, and then sets the correction coefficient in the correction filter 40. The correction filter 40 corrects a sound source signal output from an apparatus having an audio function.

As shown in FIG. 2, the correction coefficient generator 30 and correction filter 40 are provided outside the acoustic apparatus 100. Nonetheless, they may be formed integral with the acoustic apparatus 100. Alternatively, the correction coefficient generator 30 and correction filter 40 may be incorporated in an apparatus having an audio function.

If the acoustic apparatus 100 is incorporated in an apparatus having an audio function, the correction coefficient generator 30 and the correction filter 40 may be incorporated in the apparatus having an audio function, too. If the acoustic apparatus 100 is connected to the apparatus having an audio function, the correction coefficient generator 30 and the correction filter 40 may be incorporated in the apparatus having an audio function, or may instead be incorporated in the acoustic apparatus 100.

A switch 50 is changed over to output the sound source signal to the electric/acoustic transducer 20, either not corrected at all (in no-correction mode) or corrected by the correction filter 40 (in correction mode). The switch 50 is changed over by, for example, a control signal supplied from the control unit (processor) of the apparatus having an audio function. The control signal may be transmitted from controller 140 of the acoustic apparatus 100 if the acoustic apparatus 100 is incorporated in the apparatus having an audio function or formed integral with the correction filter 40.

The electric/acoustic transducer 20 may be an earphone or headphone that plugs the end of the outer-ear canal 61 of the listener 60 as illustrated in FIG. 1. The unit 20 converts an electric signal to an acoustic signal and applies the acoustic signal into the outer-ear canal 61 of the listener 60. The electric/acoustic transducer 20 also converts the acoustic signal applied into the outer-ear canal 61 of the listener 60 and reflected by the eardrum 62 of the listener 60, to an electric signal.

The controller 140 has a memory or can access a memory (not shown). The controller 140 executes a program stored in the memory, controlling the other components of the acoustic apparatus 100. The controller 140 can switch the state of the electric/acoustic transducer 20, between the first state in which the transducer 20 converts an electric signal to an acoustic signal and the second state in which the transducer 20 converts an acoustic signal to an electric signal.

The controller 140 is provided in the acoustic apparatus 100 as shown in FIG. 2. Instead, the controller 140 may be provided outside the acoustic apparatus 100. If the acoustic apparatus 100 is connected to an apparatus having an audio function, the controller (processor) of this apparatus may operate as a controller 140. In this case, the controller of the apparatus having an audio function executes a predetermined program, controlling the acoustic apparatus 100. Alternatively, the controller of the apparatus having an audio function may control the controller 140 incorporated in the acoustic apparatus 100.

The measuring signal generator 110 includes a unit pulse generator 111, a control signal generator 112, and an adder 113. The unit pulse generator 111 generates unit pulses to measure the resonance characteristic of the outer-ear canal 61 of the listener 60. The control signal generator 112 generates a signal to control the characteristic vibration of the diaphragm of the electric/acoustic transducer 20. The adder 113 adds the outputs of the unit pulse generator 111 and control signal generator 112, outputting a measuring signal.

The switch 120 is changed over to receive a signal from, or outputs a signal to, the electric/acoustic transducer 20.

When set to the first state, the switch 120 is switched to the measuring signal generator 110. In this case, the switch 120 connects the output of the measuring signal generator 110 to the electric/acoustic transducer 20. The electric/acoustic transducer 20 converts the measuring signal output from the measuring signal generator 110, to an acoustic signal. The acoustic signal is output to the outer-ear canal 61 of the listener 60.

The acoustic signal converted from the measuring signal and input to the outer-ear canal 61 of the listener 60 is reflected by the eardrum 62 of the listener 60. The electric/acoustic transducer 20 converts the acoustic signal, so reflected, to a response signal that is an electric signal. In order to receive the response signal, the switch 120 is set to the second state.

On the other hand, when set to the second state, the switch 120 is switched to the input of the response signal analysis module 130. The electric/acoustic transducer 20 collects the sound reflected by the eardrum 62 of the listener 60, i.e., measurement object, and converts the acoustic signal to an electric signal. This electric signal is output to the response signal analysis module 130. The response signal analysis module 130 acquires, from the response signal, the physical quantity inherent to the resonance characteristic of the outer-ear canal 61 of the listener 60. That is, the response signal analysis module 130 first converts the response signal, from a time domain to a frequency domain, and then detects the peak frequency and amplitude at the peak frequency, which are the physical quantities inherent to the outer-ear canal 61 of the listener 60. The physical quantity inherent to the resonance characteristic of the outer-ear canal 61 of the listener 60, which the response signal analysis module 130 has acquired, is output to the correction coefficient generator 30. The correction coefficient generator 30 generates a correction signal for the correction filter 40, from the physical quantity which the response signal analysis module 130 has obtained and which is inherent to the resonance characteristic of the outer-ear canal 61 of the listener 60. The correction filter 40 decreases the gain in terms of the resonance frequency of the outer-ear canal 61 of the listener 60, thereby correcting the frequency characteristic of the sound source signal to a flat frequency characteristic. Such calculation as performed in the correction filter 40 can be accomplished by using a parametric equalizer or a graphic equalizer.

If the switch 50 is changed over to the output side of the correction filter 40, setting the correction mode, the sound source signal corrected in accordance with the resonance characteristic of the outer-ear canal 61 of the listener 60 is input to the electric/acoustic transducer 20. That is, the correction filter 40 decreases the gain in terms of the resonance frequency, thereby correcting the frequency characteristic of the sound source signal to a flat frequency characteristic.

As described above, the electric/acoustic transducer 20 performs not only the earphone function (first state) of converting the electric signal coming from the switch 120 to an acoustic signal and supplying the acoustic signal to the measurement object, but also the microphone function (second state) of converting the acoustic signal coming from the measured object to an electric signal and supplying the electric signal to the switch 120. That is, the transducer 20 utilizes the earphone function in the first state, applying a measuring signal, i.e., acoustic signal, to the outer-ear canal 61 of the listener 60, and utilizes the microphone function in the second state, collecting the acoustic signal converted from the measuring signal and coming from the eardrum 62 of the listener 60.

If the electric/acoustic transducer 20 functions as an earphone, the diaphragm of the electric/acoustic transducer 20 converts an electric signal to an acoustic signal. At this point, the diaphragm vibrates at its specific frequency. Hence, the vibration continues even after the acoustic signal has been output to the outer-ear canal 61 of the listener 60. Assume that this vibration continues when the measuring signal is output in the first state in the process of measuring the resonance characteristic of the outer-ear canal 61 of the listener 60. Then, the vibration at the specific frequency generates a noise component in the response signal, rendering it difficult to analyze the response signal. Such vibration of the diaphragm, at the specific frequency, should therefore be controlled.

How the control signal generated by the control signal generator 112 controls or suppresses the characteristic vibration will be explained.

Figure 3:
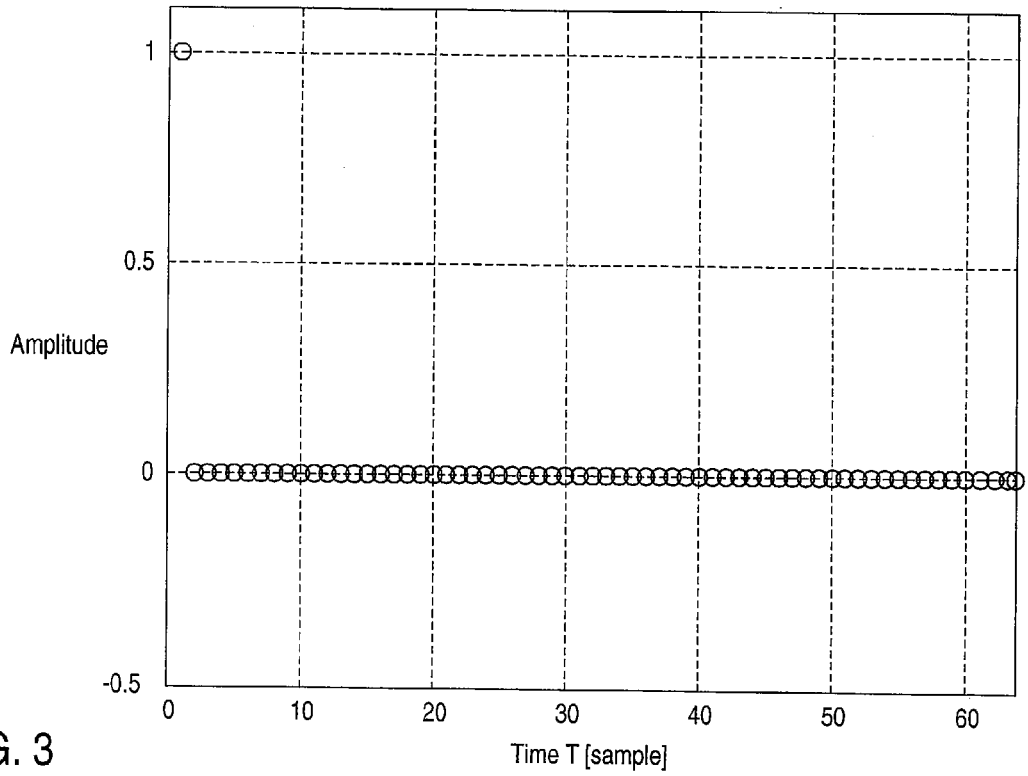
FIG. 3 is an exemplary diagram showing an exemplary unit pulse generated as a measuring signal.
Figure 4:
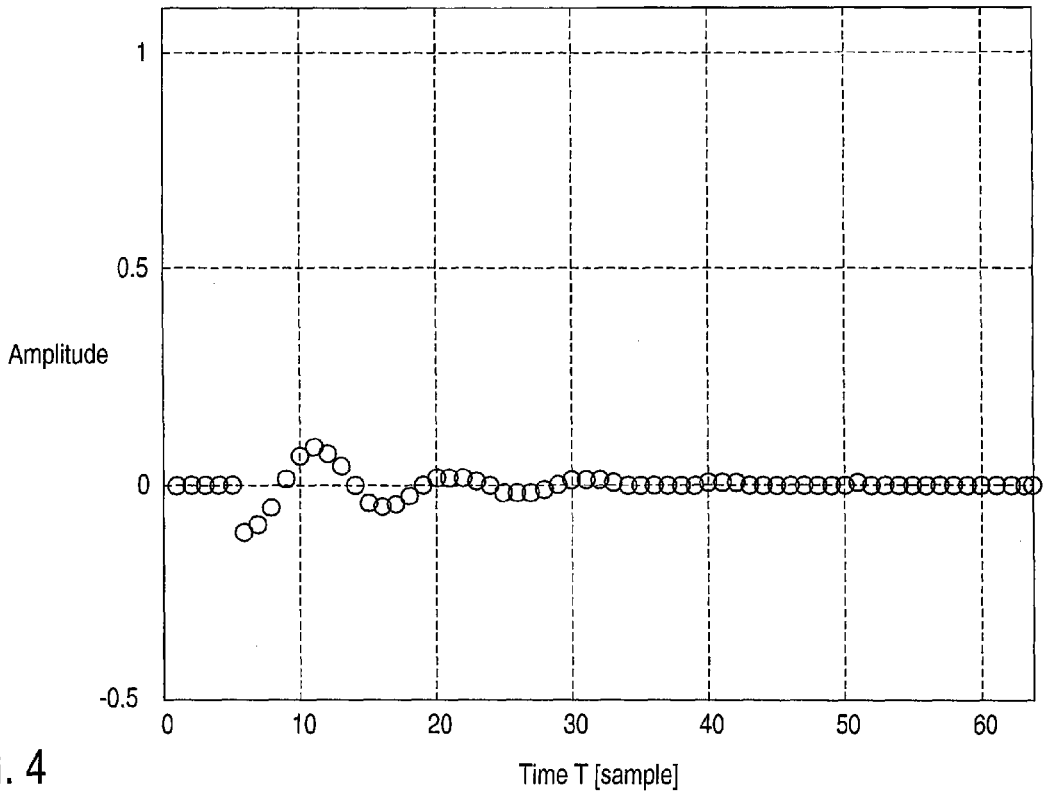
FIG. 4 is an exemplary diagram showing the result of measuring a response signal, with the electric/acoustic transducer 20 arranged in a free sound field.

FIG. 3 is a diagram showing an exemplary unit pulse generated by the unit pulse generator 111 as a measuring signal. As shown in FIG. 3, a pulse having an amplitude of 1 is generated at time T=0. FIG. 4 shows an exemplary response signal generated when no control signals generated by the control signal generator 112 are added to the unit pulse. FIG. 4 shows the result of measuring a response signal, which is obtained if the electric/acoustic transducer 20 is arranged in a free sound field (or in a space where the reflection is sufficiently small). Since the electric/acoustic transducer 20 is arranged in the free sound field, no signals should be observed. As seen from FIG. 4, however, the response signal has a component inherent to the characteristic vibration of the diaphragm. In order to control this characteristic vibration, the control signal generator 112 generates a control signal in this embodiment.

Figure 5:
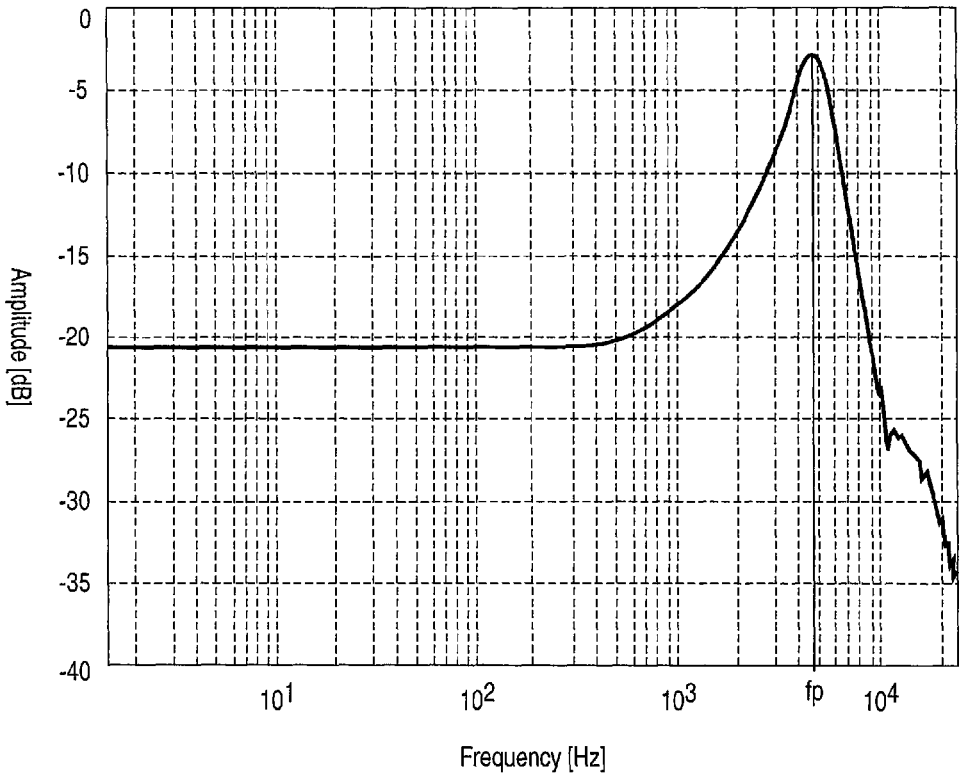
FIG. 5 is an exemplary diagram showing an exemplary acoustic characteristic of the electric/acoustic transducer 20 in the embodiment of the present invention.

The control signal generator 112 used in this embodiment utilizes the acoustic characteristic the electric/acoustic transducer 20 has in the free sound field, in order to control or suppress the characteristic vibration. FIG. 5 is a diagram that shows an exemplary acoustic characteristic the electric/acoustic transducer 20 has in the free sound field.

The acoustic characteristic shown in FIG. 5 has been measured beforehand by arranging the electric/acoustic transducer 20 in a free sound field. This acoustic characteristic has a peak at frequency fP, which is the frequency of the characteristic vibration. The control signal generator 112 generates a control signal that has a characteristic inverse to the acoustic characteristic (or characteristic that is quasi-inverse thereto). The control signal is output to the adder 113. The adder 113 adds the control signal to the unit pulse generated by the unit pulse generator 111, thus generating a measuring signal. The measuring signal, thus generated, is output to the switch 120.

Figure 6:
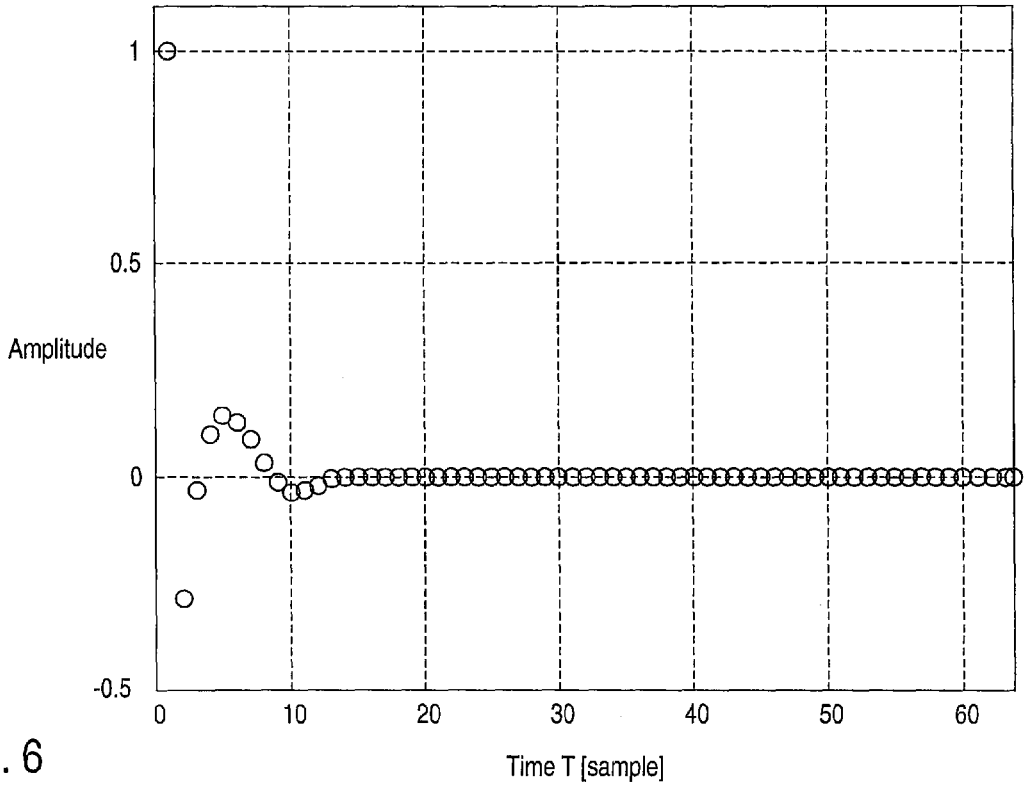
FIG. 6 is an exemplary diagram showing an exemplary measuring signal in which a control signal is added to the unit pulse.

FIG. 6 is a diagram showing an exemplary measuring signal output from the adder 113 and generated by adding the control signal to the unit pulse. In FIG. 6, not only a pulse having an amplitude of 1 at time T=0, but also the waveform of the control signal is illustrated. This control signal has been generated to exhibit a characteristic inverse to the acoustic characteristic shown in FIG. 5. A control signal of this type is output to the electric/acoustic transducer 20, whereby the characteristic vibration shown in FIG. 4 can be suppressed.

Figure 7:
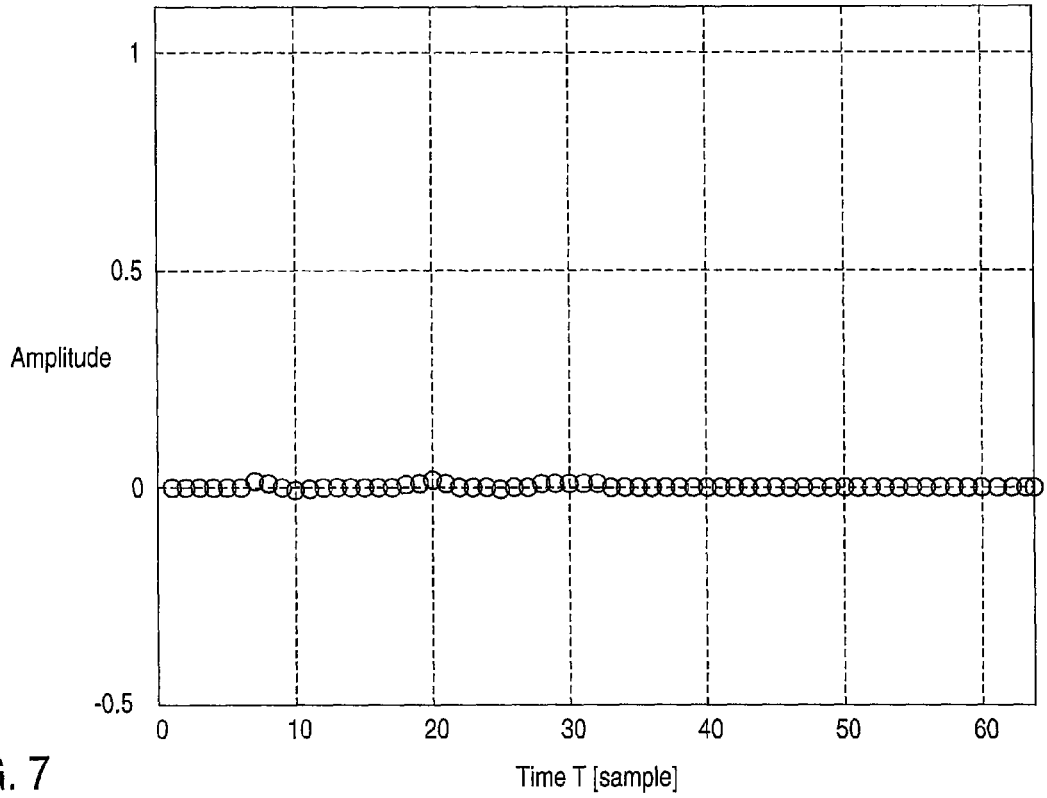
FIG. 7 is an exemplary diagram showing a response signal generated in response to a measuring signal with a control signal being added.

FIG. 7 shows an exemplary response signal that may be generated if a control signal is added to the unit pulse. That is, FIG. 7 shows the result of measuring the response signal, with the electric/acoustic transducer 20 arranged in a free sound field. As shown in FIG. 7, no signals resulting from the characteristic vibration are observed, because the characteristic vibration of the diaphragm is suppressed.

An exemplary control signal generated by the control signal generator 112 will be described. The frequency component of peak frequency fP, shown in FIG. 5 illustrating the acoustic characteristic, seems to impose a large influence on the characteristic vibration of the electric/acoustic transducer 20. Reciprocal Tp of the peak frequency fp, i.e., Tp=1/fP, has a time dimension. The control signal generator 112 delays the unit pulse generated by the unit pulse generator 111, by half the time Tp, thereby generating a pulse with amplitude calculated from the magnitude of the peak frequency. If the measuring signal generator 110 has long sampling intervals, time Tp/2 can hardly be measured. In this case, the unit pulse generated by the unit pulse generator 111 after the up-sampling is delayed by half the time Tp, generating a pulse having the amplitude calculated from the magnitude of the peak frequency. After a low-pass filter process, down-sampling is performed. That is, the sampling intervals are made so short that time Tp/2 may be measured, and a pulse is set for time Tp, thereby acquiring a waveform defined by the initial sampling intervals by means of a decimation filter or the like. The control signal, thus generated, is output to the adder 113. The adder 113 adds a control signal to the unit pulse generated by the unit pulse generator 111, generating a measuring signal. The measuring signal is output to the switch 120.

Figure 8:
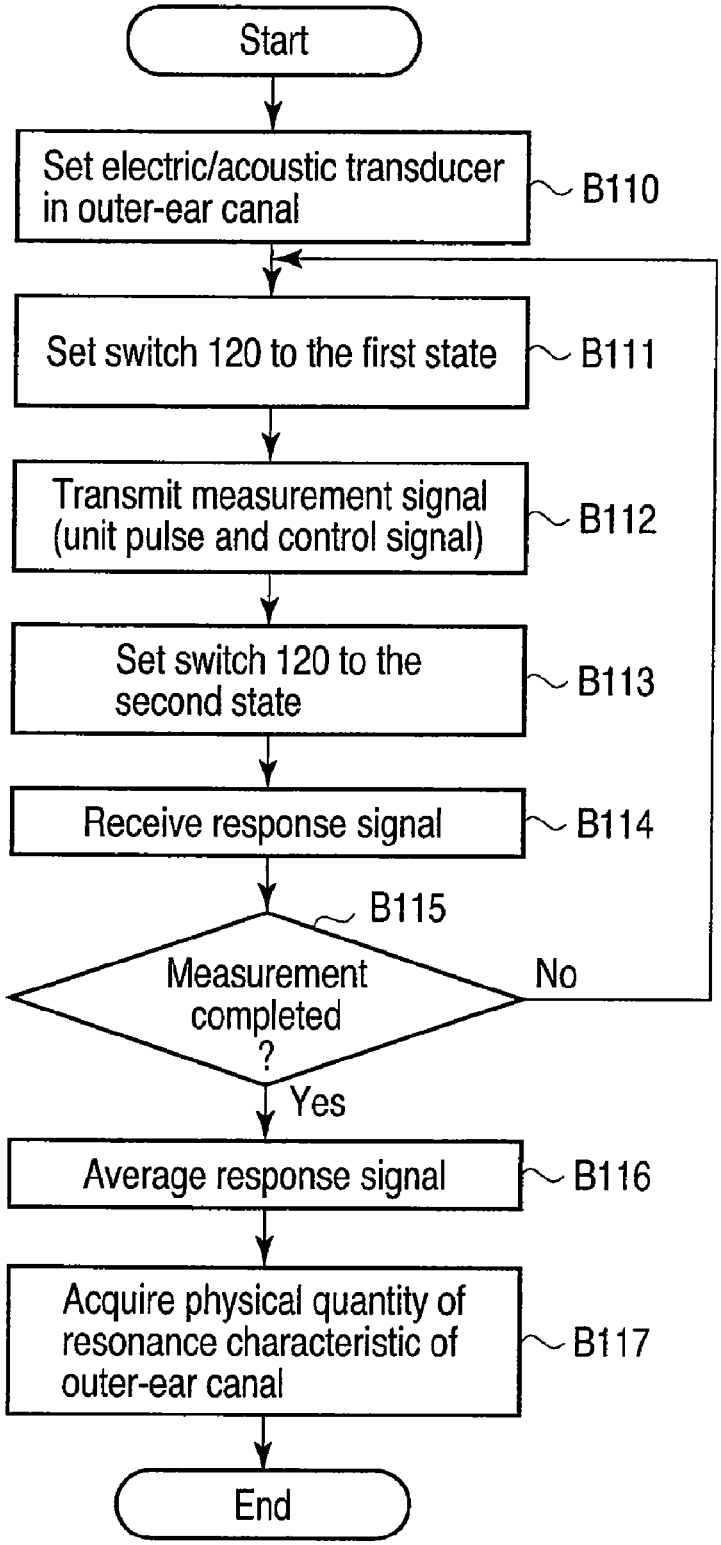
FIG. 8 is an exemplary flowchart explaining a process of measuring the resonance characteristic of the outer-ear canal 61 of a listener 60.

The process performed in the first embodiment to measure the resonance characteristic of either outer-ear canal 61 of the listener 60 will be explained. FIG. 8 is a flowchart explaining the process of measuring the resonance characteristic of the outer-ear canal 61 of the listener 60.

To measure the resonance characteristic of the outer-ear canal 61 of the listener 60, the electric/acoustic transducer 20 is inserted into the outer-ear canal 61 of the listener 60 (Block B110). Then, the switch 120 is changed over to the side of the measuring signal generator 110 and is thereby set to the first state (Block B111). The switch 120 therefore connects the output of the measuring signal generator 110 to the electric/acoustic transducer 20.

The electric/acoustic transducer 20 converts the measuring signal output from the measuring signal generator 110, which is an electric signal, to an acoustic signal. The acoustic signal is applied into the outer-ear canal 61 of the listener 60 (Block B112). The measuring signal output from the measuring signal generator 110 is an electric signal that the adder 113 has generated by adding the unit pulse generated by the unit pulse generator 111 to the control signal generated by the control signal generator 112.

Then, the controller 140 changes over the switch 120 to the input of the response signal analysis module 130, causing the electric/acoustic transducer 20 to function as a microphone to collect the sound reflected from the eardrum 62 of the listener 60 who has received the acoustic signal converted from the measuring signal. The switch 120 is therefore set to the second state (Block B113).

The sound reflected from the eardrum 62 of the listener 60, which is an acoustic signal converted from the measuring signal, is converted by the electric/acoustic transducer 20 to a response signal that is an electric signal (Block B114). The response signal is output to the response signal analysis module 130.

Next, the controller 140 determines whether the measurement has been made a predetermined number of times as required (Block B115). The measurement should be made, for example, several times. If the measurement has not been made several times yet (if No in Block B115), the process returns to Block B111. The sequence of Blocks B111 to B114 is repeated until the measurement is made a required number of times. When the earphone is used as a microphone, the response signal may be at so low a level that it is mixed with noise, because of the insufficient sensitivity of the microphone function. In this case, the measurement may not be achieved as is desired. In view of this, the first state and the second state are switched over several times to receive the response signal a number of times, thus acquiring an average value of the response signal. The signal-to-noise ratio is thereby increased.

When the measurement is completed (that is, Yes in Block B115), the response signal analysis module 130 finds an average value obtained by measuring the response signal several times (Block B116). If the response signal is received only once (that is, if the sequence of Blocks B111 to B114 is performed only once), the process of Block 116 can be omitted.

The response signal analysis module 130 acquires the physical quantity inherent to the resonance characteristic of the outer-ear canal 61 of the listener 60 (Block B117). The information for correcting the resonance characteristic of the outer-ear canal 61 of the listener 60 is thus obtained.

The physical quantity regarding the resonance characteristic of the outer-ear canal 61 of the listener 60 obtained by the response signal analysis module 130 is output to the correction coefficient generator 30. The correction coefficient generator 30 generates a correction coefficient for the correction filter 40, from the physical quantity regarding the resonance characteristic of the outer-ear canal 61 of the listener 60 obtained by the response signal analysis module 130. The correction coefficient is set in the correction filter 40.

To correct the resonance characteristic of the outer-ear canal 61 of the listener 60, the correction filter 40 corrects the sound source signal output from the apparatus having an audio function, on the basis of the resonance characteristic of the outer-ear canal 61 of the listener 60. That is, the correction filter 40 decreases the gain at the resonance frequency of the sound source signal in accordance with the correction coefficient generated by the correction coefficient generator 30 and set in the correction filter 40. The frequency characteristic is corrected to a flat one. The sound source signal thus filtered by the correction filter 40, which is an electric signal, is converted by the electric/acoustic transducer 20 to an acoustic signal, because the switch 120 is set to the first state (earphone function). The acoustic signal is output to the outer-ear canal 61 of the listener 60.

In the present embodiment, the measuring signal is thus supplied to the electric/acoustic transducer 20 via the switch 120 and is output to the outer-ear canal 61. Since the control signal generated by the control signal generator 112 is added to the measuring signal, the influence of the characteristic vibration of the diaphragm of the electric/acoustic transducer 20 can be cancelled out. The control signal generator 112 generates a control signal exhibiting a characteristic that is inverse to a characteristic of the characteristic vibration of the electric/acoustic transducer 20. The acoustic signal converted from the measuring signal and reflected by the eardrum 62 of the listener 60 is converted by the electric/acoustic transducer 20 to a response signal that is an electric signal. The response signal is supplied to the response signal analysis module 130. The response signal analysis module 130 acquires the physical quantity that is inherent to the resonance characteristic of the outer-ear canal 61 of the listener 60. The correction filter 30 generates a correction coefficient for the correction filter 40, which may cancel the resonance characteristic of the outer-ear canal 61.

Since the influence of the characteristic vibration of the diaphragm of either earphone is thus cancelled, the resonance characteristic of the listener's outer-ear canal can be accurately measured. A filter that cancels the peak of the resonance characteristic can therefore be provided based on the measurement result. Thus, even if resonance occurs in the listener's outer-ear canal, the peak of the resonance characteristic is canceled. This prevents the listener from hearing any unnatural sound. Moreover, the earphone is neither large nor complex in structure, because it incorporates no microphones. Without arranging a microphone near the earphone, a simple configuration can accurately cancel the resonance in the listener's outer-ear canal. Further, the characteristic of the resonance in the earphone and the outer-ear canal of each listener is measured and the correction filter that accords with the characteristic thus measured is formed. Therefore, the resonance characteristic of the outer-ear canal, which differs in accordance with the physical characteristics of the outer-ear canal and eardrum of each listener and with the state in which the earphone is inserted in the outer-ear canal, can be canceled. The characteristics of both the left ear and the right ear may be acquired, and two correction filters that accord to the characteristics, respectively, may be formed and used to cancel the characteristics of the left and right ears, which differ from each other.

Other embodiments of the present invention will be described. Of the components of the other embodiments, those that are identical to those of the firs embodiment are designated by the same reference numbers and will not be described in detail.

Second Embodiment

Figure 9:
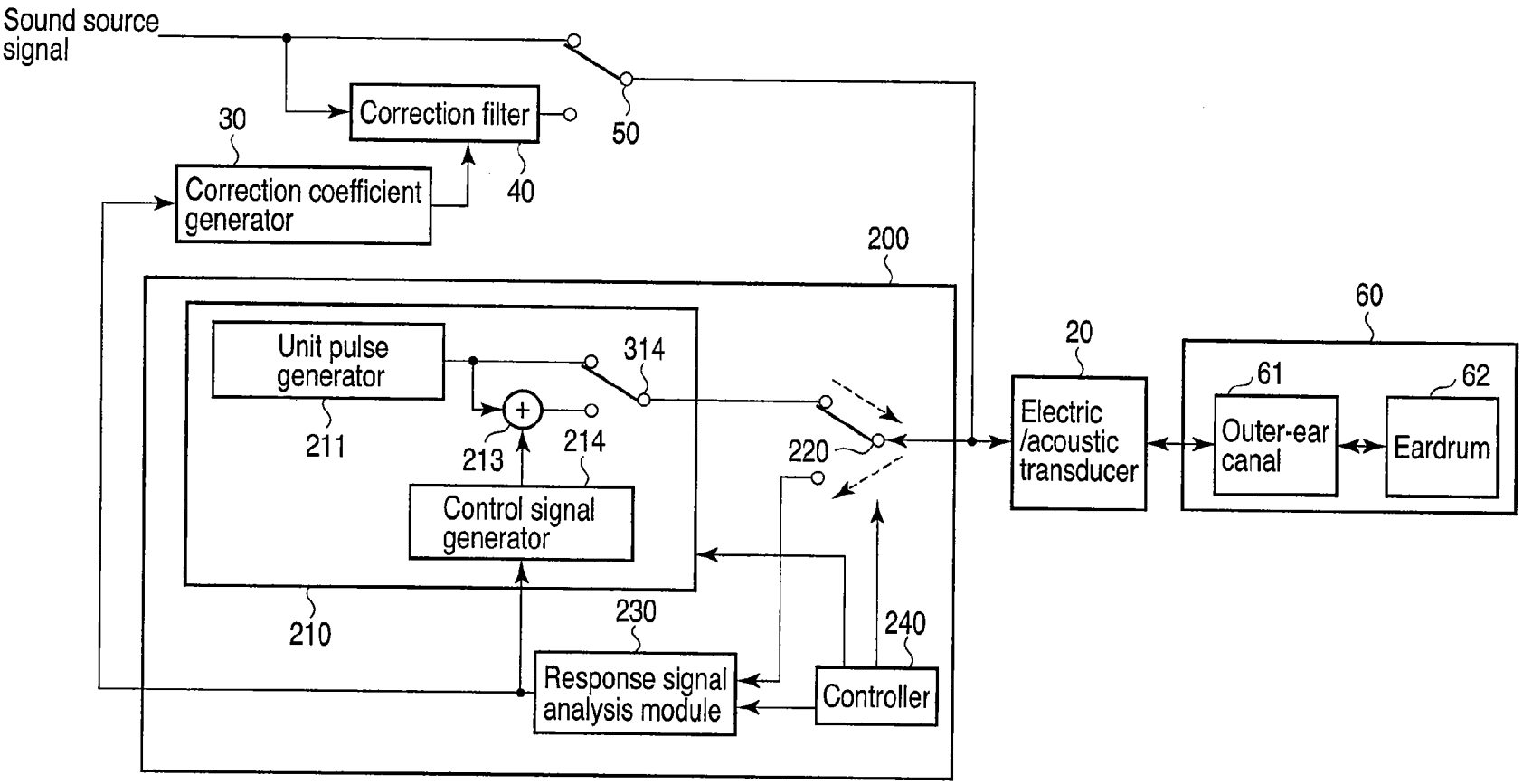
FIG. 9 is an exemplary block diagram showing an exemplary configuration of an acoustic apparatus 200 according to a second embodiment.

FIG. 9 is a block diagram showing an exemplary configuration of an acoustic apparatus 200 according to the second embodiment. The acoustic apparatus 200 is equivalent to the acoustic apparatus 100 according to the first embodiment. As in the first embodiment, the acoustic apparatus 200 comprises a measuring signal generator 210, a switch 220, a response signal analysis module 230, and a controller 240. The acoustic apparatus 200 is electrically connected to, or formed integral with, either electric/acoustic transducer 20. The acoustic apparatus 200 further comprises a switch 314.

A correction coefficient generator 30 and a correction filter 40 are arranged outside the acoustic apparatus 200. The correction coefficient generator 30 generates a correction coefficient on the basis of the resonance characteristic of either outer-ear canal 61 of a listener 60, and then sets the correction coefficient in the correction filter 40. The correction filter 40 corrects a sound source signal output from an apparatus having an audio function.

As shown in FIG. 9, the correction coefficient generator 30 and correction filter 40 are provided outside the acoustic apparatus 100. Nonetheless, they may be formed integral with the acoustic apparatus 200. Alternatively, the correction coefficient generator 30 and correction filter 40 may be incorporated in an apparatus having an audio function.

If the acoustic apparatus 200 is incorporated in an apparatus having an audio function, the correction coefficient generator 30 and the correction filter 40 may be incorporated in the apparatus having an audio function, too. If the acoustic apparatus 200 is connected to the apparatus having an audio function, the correction coefficient generator 30 and the correction filter 40 may be incorporated in the apparatus having an audio function, or may instead be incorporated in the acoustic apparatus 200.

A switch 50 is changed over to output the sound source signal to the electric/acoustic transducer 20, either not corrected at all (in no-correction mode) or corrected by the correction filter 40 (in correction mode). The switch 50 is changed over by, for example, a control signal supplied from the controller (processor) of the apparatus having an audio function. The control signal may be transmitted from controller 240 of the acoustic apparatus 200 if the acoustic apparatus 200 is incorporated in the apparatus having an audio function or formed integral with the correction filter 40.

As in the first embodiment, the electric/acoustic transducer 20 may be an earphone or headphone and has the function of converting an electric signal to an acoustic signal, and vice versa. If the mode of measuring the outer-ear canal characteristic is set, the electric/acoustic transducer 20 converts an electric signal to an acoustic signal, which is applied into the outer-ear canal 61 of the listener 60, and converts the acoustic signal reflected from the eardrum 62 of the listener 60, to an electric signal. If the mode of measuring the characteristic vibration is set, the electric/acoustic transducer 20 is not inserted into the outer-ear canal 61 of the listener 60 and is arranged in a free sound field. In this case, the characteristic vibration of the diaphragm is observed.

The controller 240 has a memory or can access a memory (not shown). The controller 240 executes a program stored in the memory, controlling the other components of the acoustic apparatus 200. The controller 240 can set two modes, i.e., the mode of measuring the resonance characteristic of the outer-ear canal 61 of the listener 60 and the mode of measuring the characteristic vibration of the diaphragm of the electric/acoustic transducer 20. Further, the controller 240 can switch the state of the electric/acoustic transducer 20, between the first state in which the transducer 20 converts an electric signal to an acoustic signal and the second state in which the transducer 20 converts an acoustic signal to an electric signal.

The controller 240 is provided in the acoustic apparatus 200 as shown in FIG. 9. Instead, the controller 240 may be provided outside the acoustic apparatus 200. If the acoustic apparatus 200 is connected to an apparatus having an audio function, the controller (processor) of this apparatus may operate as a controller 240. In this case, the controller of the apparatus having an audio function executes a predetermined program while controlling the acoustic apparatus 200. Alternatively, the controller of the apparatus having an audio function may control the controller 240 incorporated in the acoustic apparatus 200.

The measuring signal generator 210 includes a unit pulse generator 211, a control signal generator 214, an adder 213, and a switch 314. The unit pulse generator 211 generates unit pulses to measure the resonance characteristic of the outer-ear canal 61 of the listener 60. The control signal generator 214 generates a signal to control or suppress the characteristic vibration of the diaphragm of the electric/acoustic transducer 20.

To measure the resonance characteristic of the outer-ear canal, the switch 314 is connected to the output of the adder 213. The adder 213 adds the outputs of the unit pulse generator 211 and control signal generator 214, generating and outputting a measuring signal.

On the other hand, if the characteristic vibration measurement mode is set, the switch 314 is connected to the output of the unit pulse generator 211. The unit pulse generated by the unit pulse generator 211 is output directly to the switch 220.

The switch 220 is changed over to receive a signal from, or outputs a signal to, the electric/acoustic transducer 20.

When the controller 240 is set to the first state, the switch 220 is switched to the measuring signal generator 210. In this case, the switch 220 connects the output of the measuring signal generator 210 to the electric/acoustic transducer 20. The electric/acoustic transducer 20 converts the measuring signal output from the measuring signal generator 210, to an acoustic signal. The acoustic signal is output to the outer-ear canal 61 of the listener 60.

On the other hand, when the controller 240 is set to the second state, the switch 220 is switched to the input of the response signal analysis module 230. In this case, the switch 220 connects the electric/acoustic transducer 20 to the response signal analysis module 230. The electric/acoustic transducer 20 collects the sound reflected by the eardrum 62 of the listener 60, i.e., measurement object, and converts the acoustic signal to an electric signal. This electric signal is output to the response signal analysis module 230.

The response signal analysis module 230 acquires, from the response signal, the physical quantity inherent to the resonance characteristic of the outer-ear canal 61 of the listener 60. That is, the response signal analysis module 230 first converts the response signal, from a time domain to a frequency domain, and then detects the peak frequency and amplitude at the peak frequency, which are the physical quantities inherent to the outer-ear canal 61 of the listener 60.

In the present embodiment, the physical quantity inherent to the resonance characteristic of the outer-ear canal 61 of the listener 60, which the response signal analysis module 230 has acquired, can be output to either the measuring signal generator 210 or the correction coefficient generator 30.

If the output of the response signal analysis module 230 is supplied to the correction coefficient generator 30, the operation is the same as in the first embodiment. The correction coefficient generator 30 generates a correction coefficient for the correction filter 40, on the basis of the resonance characteristic of either outer-ear canal 61 of a listener 60, which the response signal analysis unit 230 has acquired. The correction filter 40 decreases the gain at the resonance frequency, correcting the frequency characteristic to a flat one. A parametric equalizer or a graphic equalizer can achieve the function of the correction filter 40. The resonance characteristic of the outer-ear canal 61 of a listener 60 can be acquired in the same way as in the first embodiment, or as shown in the flowchart of FIG. 8.

On the other hand, to make the response signal analysis module 230 measure the control signal that should be output to the measuring signal generator 210, the control signal generator 214 generates a control signal on the basis of the physical quantity inherent to the characteristic of the control signal which the response signal analysis module 230 has acquired. The response signal analysis module 230 outputs such a control signal characteristic as shown in, for example, FIG. 5, to the control signal generator 214. The control signal generator 214 generates a control signal that has a characteristic inverse to that of the input control signal (or characteristic that is quasi-inverse thereto). The control signal generated by the control signal generator 214 is output to the adder 213. The adder 213 adds the control signal to the unit pulse generated by the unit pulse generator 211, thus generating a measuring signal. The measuring signal, thus generated, is output to the switch unit 314. As a result, the pulse generator 211 outputs such a measuring signal as shown in FIG. 6.

As in the first embodiment, the control signal generator 214 delays the unit pulse generated by the unit pulse generator 211 by half the reciprocal Tp of the peak frequency fP, i.e., Tp=1/fP, thus generating a pulse having the amplitude calculated from the magnitude of the peak frequency. If the measuring signal generator 210 has long sampling intervals, time Tp/2 can hardly be measured. In this case, the unit pulse generated by the unit pulse generator 211 after the up-sampling is delayed by half the time Tp, generating a pulse having the amplitude calculated from the magnitude of the peak frequency. After a low-pass filter process, down-sampling is performed. That is, the sampling intervals are made so short that time Tp/2 may be measured, and a pulse is set for time Tp, thereby acquiring a waveform defined by the initial sampling intervals by means of a decimation filter or the like. The control signal, thus generated, is output to the adder 213. The adder 213 adds a control signal to the unit pulse generated by the unit pulse generator 211, generating a measuring signal. The measuring signal is output to the switch 220.

Thus, in the second embodiment, the switch 314 is operated to measure the resonance characteristic of the outer-ear canal 61 of the listener 60 or the characteristic vibration of the diaphragm of the electric/acoustic transducer 20. Further, a control signal can be generated on the basis of the characteristic vibration of the diaphragm of the electric/acoustic transducer 20. Therefore, the vibration characteristic of the diaphragm of the electric/acoustic transducer 20 need not be measured beforehand. Hence, the resonance characteristic of the outer-ear canal 61 of the listener 60 can be accurately measured with any earphone available.

Figure 10:
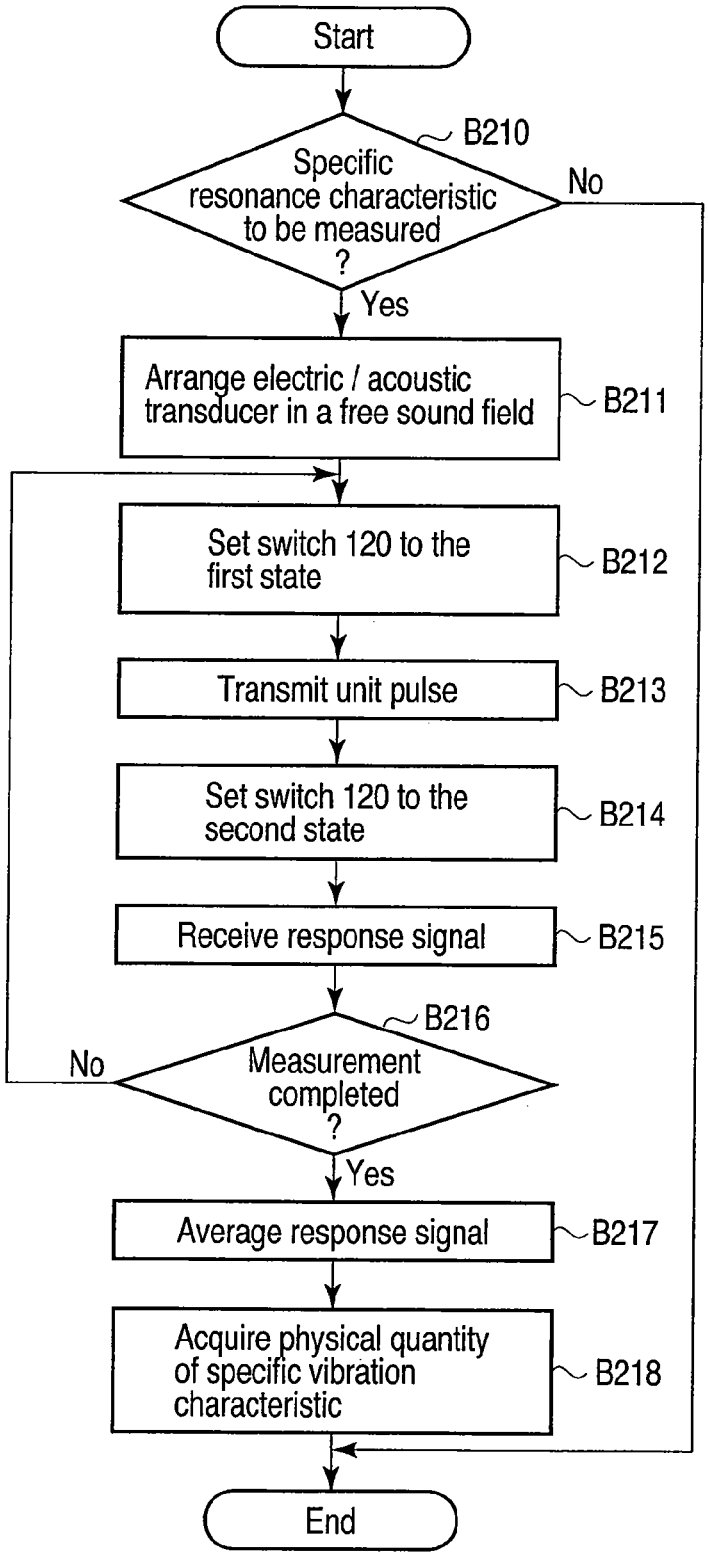
FIG. 10 is an exemplary flowchart explaining how the electric/acoustic transducer 20 performs a process of measuring the acoustic characteristic.

The process performed in the second embodiment for measuring the characteristic vibration of the diaphragm of the electric/acoustic transducer 20 will be explained. FIG. 10 is a flowchart explaining the process of measuring the characteristic vibration of the diaphragm of the electric/acoustic transducer 20.

The characteristic vibration may be measured when the electric/acoustic transducer 20 is used for the first time, or every time the electric/acoustic transducer 20 is used. Alternatively, it may be measured in accordance with the instruction of the listener 60. When to measure a characteristic of the characteristic vibration may be preset.

To measure the characteristic vibration of the diaphragm of the electric/acoustic transducer 20, the controller 240 determines whether the characteristic vibration should be measured or not (Block B210).

If a characteristic of the characteristic vibration of the diaphragm of the electric/acoustic transducer 20 has been acquired, or the characteristic vibration need not be measured (if No in Block B210), the controller 240 terminates the process. Then, the process of measuring the resonance characteristic of the outer-ear canal 61 of the listener 60 is started.

If the characteristic vibration of the diaphragm of the electric/acoustic transducer 20 should be measured (if Yes in Block B210), the electric/acoustic transducer 20 is arranged in a free sound field (Block B211). The controller 240 may cause the display of an apparatus having an audio function to display a message. The message prompts the listener 60 to remove the electric/acoustic transducer 20 from his or her ear so that no reflection may occur.

Then, the controller 240 sets the mode of measuring the characteristic vibration. The switch 314 is thereby changed over to the output side of the unit pulse generator 211.

Next, the switch 220 is changed over to the measuring signal generator 210. Therefore, the electric/acoustic transducer 20 functions as an earphone for outputting a measuring signal and the switch 220 is set to the first state (Block B212). The switch 220 therefore connects the output of the measuring signal generator 210 to the electric/acoustic transducer 20.

The unit pulse generated by the unit pulse generator 211 is output from the measuring signal generator 210 to the electric/acoustic transducer 20. The electric/acoustic transducer 20 converts the unit pulse to an acoustic signal (Block B213). The controller 240 changes over the switch 220 to the input side of the response signal analysis module 230, setting the switch 220 to the second state (Block B214).

The electric/acoustic transducer 20 converts the characteristic vibration of the diaphragm, caused by the unit pulse, to a characteristic vibration signal (response signal), which is an electric signal (Block B215). The response signal is output to the response signal analysis module 230.

Next, the controller 240 determines whether the measurement has been made a specific number of times as required (Block B216). The measurement should be made, for example, several times. If the measurement has not been made several times (if No in Block B216), the process returns to Block B212. The sequence of Blocks B212 to B215 is repeated until the measurement is made a required number of times. When the earphone is used as a microphone, the response signal may be at so low a level that it is mixed in with noise, because of the insufficient sensitivity of the microphone function. In this case, the measurement may not be achieved as is desired. In view of this, the first state and the second state can be switched over several times to receive the response signal a number of times.

When the measurement is completed (that is, Yes in Block B216), the response signal analysis module 130 finds an average value obtained by measuring the response signal several times (Block B217). If the response signal is received only once, the process of Block 217 can be dispensed with.

The response signal analysis module 230 acquires the physical quantity inherent to a characteristic of the characteristic vibration of the diaphragm of the electric/acoustic transducer 20 (Block B218). The physical quantity inherent to the characteristic vibration of the diaphragm of the electric/acoustic transducer 20, which is acquired by the response signal analysis module 230, is supplied to the control signal generator 214.

The physical quantity inherent to the characteristic vibration of the diaphragm of the electric/acoustic transducer 20 is thus acquired. The control signal generator 214 can generate a control signal on the basis of the physical quantity inherent to the characteristic vibration of the diaphragm of the electric/acoustic transducer 20.

To measure the resonance characteristic of the outer-ear canal 61 of the listener 60, the switch 314 is changed over to the output of the adder 213. A process similar to the process shown in the flowchart of FIG. 8 is performed, measuring the resonance characteristic of the outer-ear canal 61 of the listener 60.

To correct the resonance characteristic of the outer-ear canal 61 of the listener 60, the sound source signal output from the apparatus having an audio function is corrected by the correction filter 40. The correction filter 40 decreases the gain at the resonance frequency of the sound source signal in accordance with the correction coefficient generated by the correction coefficient generator 30 and set in the correction filter 40. The frequency characteristic is thereby corrected to a flat one. The sound source signal thus filtered by the correction filter 40, which is an electric signal, is converted by the electric/acoustic transducer 20 to an acoustic signal, because the switch 220 is set to the first state (earphone function). The acoustic signal is output to the outer-ear canal 61 of the listener 60.

Thus, in the present embodiment, the switch 314 outputs the unit pulse via the switch 220 to the electric/acoustic transducer 20 while the characteristic vibration is being measured. The unit pulse causes the diaphragm of the electric/acoustic transducer 20 to undergo characteristic vibration. The electric/acoustic transducer 20 converts the characteristic vibration to a characteristic vibration signal (response signal). The response signal is output the response signal analysis module 230. The response signal analysis module 230 acquires the physical quantity that is inherent to the characteristic vibration of the diaphragm of the electric/acoustic transducer 20. The physical quantity that is inherent to the characteristic vibration of the diaphragm of the electric/acoustic transducer 20, thus acquired, is output to the control signal generator 214. The control signal generator 214 generates a control signal that exhibits a characteristic inverse to that of the input control signal. In the present embodiment, a physical quantity inherent to the characteristic vibration of the diaphragm of the electric/acoustic transducer 20 can be acquired, and a control signal can be generated, which accords with the physical quantity inherent to the characteristic vibration of the diaphragm of the electric/acoustic transducer 20.

To measure the resonance characteristic of the outer-ear canal 61 of the listener 60, a measuring signal, to which the unit pulse has been added, is supplied from the switch 220 to the electric/acoustic transducer 20. The electric/acoustic transducer 20 converts the measuring signal, which is an electric signal, to an acoustic signal. The acoustic signal is output to the outer-ear canal 61 of the listener 60. The measuring signal, to which the control signal generated by the control signal generator 214 is added, can cancel the influence of the characteristic vibration of the diaphragm of the electric/acoustic transducer 20. The electric/acoustic transducer 20 converts the acoustic signal converted from the eardrum 62 of the listener 60, to a response signal that is an electric signal. The response signal is supplied to the response signal analysis module 230. The response signal analysis module 230 acquires the physical quantity inherent to the resonance characteristic of the outer-ear canal 61 of the listener 60. The correction coefficient generator 30 generates a correction coefficient for the correction filter 40, which may cancel the resonance characteristic.

Since the influence of the characteristic vibration of the diaphragm is canceled in either earphone, the resonance characteristic of the outer-ear canal 61 of the listener 60 can be measured accurately. A filter that cancels the peak is therefore formed in accordance with the result of measuring. Hence, the peak of the resonance characteristic can be canceled even if resonance occurs in the outer-ear canal of the listener. This prevents the listener from hearing any unnatural sound. Moreover, the earphone is neither large nor complex in structure, because it incorporates no microphones. Without arranging a microphone near the earphone, a simple configuration can accurately cancel the resonance in the listener's outer-ear canal. Further, the resonance characteristic of the outer-ear canal, which differs in accordance with the physical characteristics of the outer-ear canal and eardrum and with the state in which the earphone is inserted in the outer-ear canal, can be canceled, because the characteristic of the resonance in the earphone and the outer-ear canal is measured and the correction filter that accords with the characteristic thus measured is formed and used.

As described above, the process (FIG. 10) of acquiring the physical quantity inherent to the characteristic vibration of the diaphragm of the electric/acoustic transducer 20 and the process (FIG. 8) of measuring the physical quantity inherent to the resonance characteristic of the outer-ear canal 61 of the listener 60 are performed independently. Nonetheless, these processes may be performed continuously, one after the other.

Figure 11:
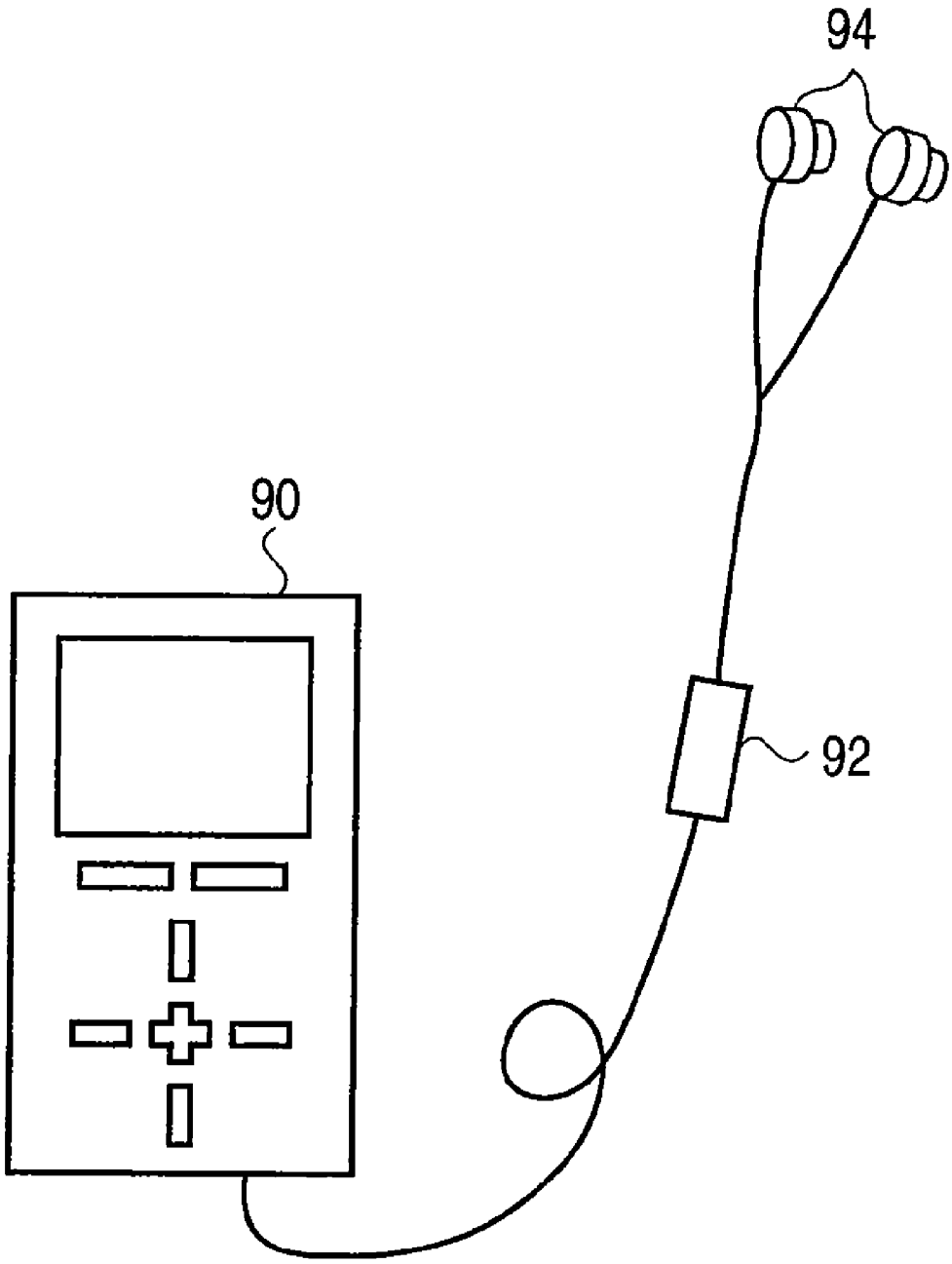
FIG. 11 is an exemplary diagram showing an exemplary use of the acoustic apparatus according to an embodiment of the invention.

FIG. 11 is a diagram showing an exemplary use of the acoustic apparatus 100 according to the first embodiment or acoustic apparatus 200 according to the second embodiment. If acoustic apparatus 100 or 200 is incorporated in an audio player 90, the apparatus may be incorporated not in the main unit of the player 90, but in a remote control 92 or an earphone 94. Further, the apparatus 100 or 200 need not be incorporated, in its entirely, in the audio player 90. Rather, the correction filter 40 may be singularly incorporated in the audio player 90. That is, the audio player 90 may use the correction filter 40 to correct sound source signals read from a flash memory, a hard disk or the like (not shown), whereas a personal computer, for example, may generate measuring signals, may measure the resonance characteristics and may generate a correction coefficient. Alternatively, if the correction filter 40 is incorporated in the audio player 90, a sound source signal may be first corrected and may then be stored (downloaded) into a memory or the like.

The resonance characteristic of the outer-ear canal 61 of the listener 60 may differ in accordance with the physical characteristics of the outer-ear canal and eardrum and with the state in which the earphone is inserted in the outer-ear canal. Therefore, the characteristic vibration of the electric/acoustic transducer 20 and the resonance characteristic of the outer-ear canal 61 of the listener 60 may be measured and corrected in the acoustic apparatus 200, for example, very time the audio player 90 is activated, when the user operates the apparatus 200, or upon the lapse of a time the user has preset.

According to an embodiment of the present invention, an acoustic apparatus comprises a measuring signal generator configured to generate a pulse; a transducer configured to convert the pulse to a sound to be output to a free sound field and to convert a characteristic vibration of the transducer to a characteristic vibration signal; a signal analysis module configured to analyze the characteristic vibration signal in order to output a physical quality representing the characteristic vibration of the transducer; a controller configured to set one of a first state in which the transducer converts an electric signal to a sound and a second state in which the transducer converts a sound to an electric signal; and a switch configured to connect the measuring signal generator to the transducer in the first state and to connect the signal analysis module to the transducer in the second state.

According to another embodiment of the present invention, an acoustic apparatus comprises a measuring signal generator comprising a pulse generator configured to generate a pulse, a control signal generator configured to generate a control signal, and an adder configured to add the measuring pulse and the control signal in order to generate a measuring signal; a transducer comprising a diaphragm of which characteristic vibration is controlled by the control signal and configured to convert the measuring signal to a measuring sound to be applied to a measurement object and to convert a measuring sound reflected from the measurement object to a response signal; a response signal analysis module configured to analyze the response signal in order to output a physical quantity representing an acoustic characteristic of the measurement object; a controller configured to set one of a first state in which the transducer converts an electric signal to a sound and a second state in which the transducer converts a sound to an electric signal; and a switch configured to connect the measuring signal generator to the transducer in the first state and to connect the response signal analysis module to the transducer in the second state.

According to another embodiment of the present invention, an acoustic apparatus comprises a measuring signal generator configured to generate a measuring pulse to be converted to a sound by a transducer in a free sound field; a signal analysis module configured to analyze a characteristic vibration of the transducer in order to output a physical quality representing the characteristic vibration of the transducer; a controller configured to set one of a first state in which the transducer converts an electric signal to a sound and a second state in which the transducer converts a sound to an electric signal; and a switch configured to connect the measuring signal generator to the transducer in the first state and to connect the signal analysis module to the transducer in the second state.

According to another embodiment of the present invention, an acoustic apparatus comprises a measuring signal generator comprising a pulse generator configured to generate a pulse, a control signal generator configured to generate a control signal for controlling a characteristic vibration of a transducer, and an adder configured to add the measuring pulse and the control signal in order to generate a measuring signal; a signal analysis module configured to analyze a response signal output from the transducer by converting a measuring sound corresponding to the measuring signal and reflected from a measurement object in order to output a physical quantity representing an acoustic characteristic of the measurement object; a controller configured to set one of a first state in which the transducer converts an electric signal to a sound and a second state in which the transducer converts a sound to an electric signal; and a switch configured to connect the measuring signal generator to the transducer in the first state and to connect the signal analysis module to the transducer in the second state.

According to another embodiment of the present invention, a method of measuring a characteristic vibration, comprises generating a pulse; converting, with a transducer, the pulse to a sound in a free sound field and converting a characteristic vibration of the transducer to a characteristic vibration signal; analyzing the characteristic vibration signal in order to output a physical quantity representing the characteristic vibration of the transducer; and setting one of a first state in which the transducer converts an electric signal to a sound and a second state in which the transducer converts a sound to an electric signal.

According to another embodiment of the present invention, a method of measuring an acoustic characteristic, comprises generating a pulse; generating a control signal for controlling a characteristic vibration of a transducer; outputting a measuring signal by adding the pulse and the control signal; converting, with the transducer, the measuring signal to a measuring sound and converting a measuring sound reflected from a measurement object to a response signal; analyzing the response signal in order to output a physical quantity representing an acoustic characteristic of the measurement object; and setting one of a first state in which the transducer converts an electric signal to a sound and a second state in which the transducer converts a sound to an electric signal.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The various modules of the systems described herein can be implemented as software applications, hardware and/or software modules, or components on one or more computers, such as servers. While the various modules are illustrated separately, they may share some or all of the same underlying logic or code. The accompanying claims and their equivalents are intended to cover such forms or modifications as would fall within the scope and spirit of the inventions.

What is claimed is:

1. An acoustic apparatus comprising:

a measuring signal generator configured to generate a unit pulse;

an electric-acoustic transducer comprising a vibrator and configured to convert an electric signal to a sound by acoustically reproducing the unit pulse in a free sound field and to convert a characteristic vibration of the vibrator which is generated by an acoustic reproduction of the unit pulse to an electric characteristic vibration signal;

a response signal analysis module configured to analyze the characteristic vibration signal in order to output a physical quality representing a characteristic vibration of the electric-acoustic transducer;

a controller configured to set one of a first state in which the electric-acoustic transducer converts an electric signal to a sound and a second state in which the electric-acoustic transducer converts a sound to an electric signal; and a switch configured to connect the measuring signal generator to the electric-acoustic transducer in the first state and to connect the response signal analysis module to the electric-acoustic transducer in the second state, wherein the measuring signal generator comprises:

a control signal generator configured to generate a control signal in order to control the characteristic vibration of the vibrator based on the physical quantity representing the characteristic vibration; and an adder configured to add the unit pulse and the control signal in order to output the measuring signal;

the electric-acoustic transducer is configured to convert an electric signal to a sound by acoustically reproducing the measuring signal at a measurement object and to convert a sound to an electric response signal by collecting a reflection sound of the measuring signal which is acoustically reproduced at the measurement object; and the response signal analysis module is configured to output, based on the response signal, a physical quantity representing an acoustic characteristic of the measurement object.

2. The apparatus of claim 1, wherein the control signal generator is configured to generate a signal representing an inverse characteristic or a substantially inverse characteristic of the characteristic vibration.

3. The apparatus of claim 1, wherein the control signal generator is configured to delay the unit pulse by a time corresponding to a half of a reciprocal of a peak frequency of the characteristic vibration in order to generate a pulse having an amplitude calculated from a magnitude of the peak frequency of the characteristic vibration.

4. The apparatus of claim 1, wherein the control signal generator is configured to delay the unit pulse by a time corresponding to a half of a reciprocal of a peak frequency of the characteristic vibration after up-sampling a sampling frequency at a time of reproduction, to perform a low-pass filter process on a pulse having an amplitude calculated from a magnitude of the peak frequency of the characteristic vibration, and to down-sample the pulse to which the low-pass filter process is performed.

5. The apparatus of claim 1, wherein the electric-acoustic transducer comprises an earphone or a headphone, the measurement object comprises an outer-ear canal of a listener, and the acoustic characteristic of the measurement object comprises a resonance characteristic of the outer-ear canal closed with the electric-acoustic transducer.

6. The apparatus of claim 1, further comprising a correction filter configured to correct a sound source signal supplied to the measurement object in accordance with a predetermined characteristic; and a correction coefficient generator configured to generate a correction coefficient for the correction filter based on the physical quantity representing the acoustic characteristic of the measurement object.

7. An acoustic apparatus comprising:

a measuring signal generator comprising a unit pulse generator configured to generate a unit pulse, a control signal generator configured to generate a control signal which controls a characteristic vibration of a vibrator, and an adder configured to add the unit pulse and the control signal in order to generate a measuring signal;

an electric-acoustic transducer comprising the vibrator and configured to convert an electric signal to a sound by acoustically reproducing the measuring signal at a measurement object and to convert a sound to an electric response signal by collecting a reflection sound of the measuring signal which is acoustically reproduced at the measurement object;

a response signal analysis module configured to analyze the response signal in order to output a physical quantity representing an acoustic characteristic of the measurement object;

a controller configured to set one of a first state in which the electric-acoustic transducer converts an electric signal to a sound and a second state in which the electric-acoustic transducer converts a sound to an electric signal; and a switch configured to connect the measuring signal generator to the electric-acoustic transducer in the first state and to connect the response signal analysis module to the electric-acoustic transducer in the second state.

8. The apparatus of claim 7, further comprising a correction filter configured to correct a sound source signal supplied to the measurement object; and a correction coefficient generator configured to generate a correction coefficient for the correction filter based on the physical quantity of the measurement object.

9. An acoustic apparatus comprising:

a measuring signal generator configured to generate a unit pulse to be converted to a sound by an electric-acoustic transducer in a free sound field;

a response signal analysis module configured to analyze an electric characteristic vibration signal of the electric-acoustic transducer which is converted from a characteristic vibration of the electric-acoustic transducer which is generated by an acoustic reproduction of the unit pulse by the electric-acoustic transducer in order to output a physical quality representing the characteristic vibration of the electric-acoustic transducer;

a controller configured to set one of a first state in which the electric-acoustic transducer converts an electric signal to a sound and a second state in which the electric-acoustic transducer converts a sound to an electric signal; and a switch configured to connect the measuring signal generator to the electric-acoustic transducer in the first state and to connect the response signal analysis module to the electric-acoustic transducer in the second state, wherein the measuring signal generator comprises:

a control signal generator configured to generate a control signal in order to control the characteristic vibration of the vibrator based on the physical quantity representing the characteristic vibration; and an adder configured to add the unit pulse and the control signal in order to output the measuring signal;

the electric-acoustic transducer is configured to convert an electric signal to a sound by acoustically reproducing the measuring signal at a measurement object and to convert a sound to an electric response signal by collecting a reflection sound of the measuring signal which is acoustically reproduced at the measurement object; and the response signal analysis module is configured to output, based on the response signal, a physical quantity representing an acoustic characteristic of the measurement object.

10. An acoustic apparatus comprising:

a measuring signal generator comprising a unit pulse generator configured to generate a unit pulse, a control signal generator configured to generate a control signal which controls a characteristic vibration of a vibrator of an electric-acoustic transducer, and an adder configured to add the unit pulse and the control signal in order to generate a measuring signal to be acoustically reproduced by the electric-acoustic transducer;

a response signal analysis module configured to output a physical quality representing a characteristic vibration of a measurement object based on a response signal which is obtained by collecting a reflection sound of the measuring signal which is acoustically reproduced at the measurement object by the electric-acoustic transducer and converting a collected sound to an electric signal;

a controller configured to set one of a first state in which the electric-acoustic transducer converts an electric signal to a sound and a second state in which the electric-acoustic transducer converts a sound to an electric signal; and a switch configured to connect the measuring signal generator to the electric-acoustic transducer in the first state and to connect the response signal analysis module to the electric-acoustic transducer in the second state.

11. An acoustic characteristic measurement method comprising steps of:

generating a unit pulse;

generating a control signal which controls a characteristic vibration of a vibrator;

outputting an addition signal of the unit pulse and the control signal;

converting an electric signal to a sound by acoustically reproducing the measurement signal at a measurement object by an electric-acoustic transducer including a vibrator and converting a sound to an electrical response signal by collecting a reflection sound of the measuring signal from the measurement object;

acquiring a physical quality representing an acoustic characteristic of the measurement object based on the response signal;

selectively setting one of a first state in which the electric-acoustic transducer converts an electric signal to a sound and a second state in which the electric-acoustic transducer converts a sound to an electric signal; and connecting the measuring signal generator to the electric-acoustic transducer in the first state and to connect the response signal analysis module to the electric-acoustic transducer in the second state.

* * * * *